US009045917B2

(12) United States Patent
Gschweng et al.

(10) Patent No.: US 9,045,917 B2
(45) Date of Patent: Jun. 2, 2015

(54) VEHICLE SIDE DOOR ASSEMBLY

(75) Inventors: Jörg Gschweng, Mainz (DE); Andreas Heberer, Mainz (DE); Peter Eduard Schuessler, Hösbach (DE); Thorsten Luedtke, Mainz (DE); Winfried Langendorf, Wiesbaden (DE)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 1002 days.

(21) Appl. No.: 12/509,353

(22) Filed: Jul. 24, 2009

(65) Prior Publication Data

US 2010/0019512 A1 Jan. 28, 2010

(30) Foreign Application Priority Data

Jul. 25, 2008 (GB) ..... 0813625.1

(51) Int. Cl.

| | |
|---|---|
| ***E05B 3/00*** | (2006.01) |
| ***E05B 53/00*** | (2006.01) |
| ***E05B 85/10*** | (2014.01) |
| ***E05B 77/04*** | (2014.01) |
| *E05B 65/10* | (2006.01) |
| *E05B 79/06* | (2014.01) |

(52) U.S. Cl.

CPC ..... *E05B 53/00* (2013.01); *E05B 85/10* (2013.01); *E05B 77/04* (2013.01); *E05B 79/06* (2013.01); *Y10S 292/65* (2013.01)

(58) Field of Classification Search

USPC ..... 292/217, 336.3, DIG. 65

See application file for complete search history.

(56) References Cited

U.S. PATENT DOCUMENTS

| | | | | |
|---|---|---|---|---|
| 4,433,506 | A | 2/1984 | Manning | |
| 5,431,462 | A | 7/1995 | Lignell | |
| 5,584,516 | A * | 12/1996 | Cetnar | 292/336.3 |
| 6,042,159 | A | 3/2000 | Spitzley et al. | |
| 6,415,636 | B1 | 7/2002 | Fukumoto et al. | |
| 6,880,867 | B2 * | 4/2005 | Schoen et al. | 292/216 |
| 2004/0251693 | A1 | 12/2004 | Schoen et al. | |

(Continued)

FOREIGN PATENT DOCUMENTS

| | | | |
|---|---|---|---|
| DE | 7014950 | U | 4/1970 |
| DE | 4413027 | A1 | 10/1994 |

(Continued)

OTHER PUBLICATIONS

German Patent Office, German Search Report for German Application No. 102009031744.9, Dec. 1, 2009.

British Patent Office, British Search Report for British Application No. 0813625.1, Nov. 17, 2008.

(Continued)

*Primary Examiner* — Carlos Lugo

(74) *Attorney, Agent, or Firm* — Ingrassia Fisher & Lorenz PC

(57) ABSTRACT

A side door of a motorized vehicle is provided that includes, but is not limited to a latch mechanism being adapted to cooperate and to engage with a latch member disposed at a door frame. The side door assembly further has an actuator for unlatching the latch mechanism. Further, the latch mechanism and the actuator are mechanical interconnected by a coupling being adapted to transfer an unlatching motion from the actuator to the latch mechanism. Additionally, the side door assembly comprises an impact member that is adapted to at least locally deform the coupling in such a way that the arising deformation counteracts the unlatching motion.

17 Claims, 7 Drawing Sheets

(56) References Cited

U.S. PATENT DOCUMENTS

| | | | | |
|---|---|---|---|---|
| 2005/0127682 | A1 | 6/2005 | Cetnar et al. | |
| 2007/0029835 | A1 | 2/2007 | Herline et al. | |
| 2007/0069525 | A1 | 3/2007 | Ghannam | |
| 2010/0109350 | A1 | 5/2010 | Gschweng et al. | |
| 2011/0062747 | A1* | 3/2011 | Teramoto et al. ..... | 296/146.1 |

FOREIGN PATENT DOCUMENTS

| | | | |
|---|---|---|---|
| DE | 69504908 | T2 | 2/1999 |
| DE | 19747710 | A1 | 5/1999 |
| DE | 102004061141 | A1 | 7/2006 |
| DE | 202006015143 | U1 | 12/2006 |
| DE | 102008039509 | A1 | 3/2010 |
| GB | 1442394 | A | 7/1976 |
| GB | 2361675 | A | 10/2001 |

OTHER PUBLICATIONS

British Patent Office, British Examination Report for Country Application No. 0813625.1, dated Dec. 13, 2011.

German Patent Office, German Search Report for Application Nol 102009051536.4, dated Mar. 23, 2010.

USPTO, US Office Action issued in U.S. Appl. No. 12/265,674, mailed Sep. 12, 2011.

Response to US Office Action for U.S. Appl. No. 12/265,674, dated Dec. 9, 2011.

USPTO, US Office Action issued in U.S. Appl. No. 12/265,674, mailed Feb. 6, 2012.

Response to US Office Action for U.S. Appl. No. 12/265,674, dated Apr. 18, 2012.

USPTO, Final Office Action issued in U.S. Appl. No. 12/265,674, mailed May 2, 2012.

Response to US Office Action for U.S. Appl. No. 12/265,674, dated Jul. 2, 2012.

* cited by examiner

VEHICLE SIDE DOOR ASSEMBLY

CROSS-REFERENCE TO RELATED APPLICATION

This application claims priority to British Patent Application No. 0813625.1, filed Jul. 25, 2008, which is incorporated herein by reference in its entirety.

TECHNICAL FIELD

The present invention is related to a side door of a motorized vehicle and comprises a latch mechanism being adapted to cooperate with a latch member disposed at a door frame. The side door further as at least one actuator for unlatching the latch mechanism, whereby the actuator is disposed at a distance from the latch mechanism.

BACKGROUND

Vehicle doors comprising a latch mechanism and a corresponding actuator are known in the art. A latch mechanism disposed in the wing of the vehicle door is mechanically linked to a latch-releasing member, such as a door handle. A user-initiated movement of a door handle is coupled to the latch mechanism in order to mutually release the latch member and the latch mechanism, which allows the side door wing to be opened. For instance, the latch mechanism, which is disposed in the door wing, comprises a detent, which engages with a latch member, being disposed at the door frame and which may comprise an anchor-, bolt- or -pin-like geometry.

A coupling between the latch mechanism and the actuator, in particular for unlatching of the latch mechanism usually takes the form of a pull or push rod. However, in a crash situation, this particular rod may become subject to deformation, which may lead to an unintentional unlatching of the latch mechanism and release of the latch member, thus leading to an inadvertent opening of the vehicle side door.

Furthermore, during a vehicle crash the actuator itself may become subject to a displacement, which may lead to an unlatching motion of that portion of the rod being coupled to the latch mechanism. Further, in a crash situation, the actuator, for instance a handle bar itself may become subject to an unlatching motion, which might be due to local deformations of the side door structure in the vicinity of the handle.

For instance, GB 1 442 394 discloses a vehicle door having a latch assembly and a locking member, which is movable to a locking position such that subsequent movement of an unlatching member is not transmitted to a detent of the latch assembly. Further, there is provided a latch releasing actuator being connected to the unlatching member by means of an unlatching or latch-releasing rod. A further rod is arranged close to the unlatching rod and extends in substantially the same direction. The two rods are arranged in such a manner, that in the event of lateral distortion of the further rod, the resultant tensile force exerted by the further rod on said component of the latch assembly is sufficient to ensure, that the locking member is moved into that locking position. However, such an assembly is rather elaborate and complex and made not sufficiently assert, that the latch mechanism remains locked upon a side impact. Furthermore, an unlatching rod interconnecting a latch-releasing actuator, such as a door handle and a latch mechanism could potentially be deformed during a crash event.

The present invention therefore aims to provide a vehicle side door assembly having a reduced propensity to open inadvertently in case of a crash situation. It is a further aim of the present invention that the functional members of a side door assembly become adapted to respond to crash-induced deformations in such a way, that the potential for an inadvertent latch-releasing or side door opening can be minimized. Furthermore, other aims, desirable features and characteristics will become apparent from the subsequent summary and detailed description, and the appended claims, taken in conjunction with the accompanying drawings and this background.

SUMMARY

The embodiments of present invention provide a side door assembly for a motorized vehicle comprising a latch mechanism, which is adapted to cooperate with a latch member being disposed at a door frame. The side door assembly further has at least one actuator, in particular a latch-releasing actuator for unlatching the latch mechanism, whereby the actuator is disposed at a distance from the latch mechanism.

The at least one actuator and the latch mechanism are mechanically coupled by coupling means. These coupling means are adapted to transmit or to transfer an unlatching motion to the latch mechanism, which is initiated by the actuator. Due to this coupling between the latch-releasing actuator and the latch mechanism, a detent element of the latch mechanism may disengage from its counterpart, being disposed at the door frame, thus leading to a release of the latch mechanism and to an opening of the side door.

According to the embodiment of present invention, there is provided an impact member, which is adapted to at least locally deform the coupling means in such a way, that the achievable deformation of a coupling means counteracts the unlatching motion, which is initiated by means of a latch-releasing actuator. The shape and geometry of the impact member and further is positioning in the side door assembly is chosen such, that an impact-induced deformation of the coupling means only occurs in case of a crash situation.

The geometry of the impact member and its arrangement relative to the coupling means inside the side door assembly is designed in such a way, that the impact member is adapted to impact and/or to impinge the coupling means in response to an externally induced deformation of the door structure. Hence, the impact member is adapted to induce a well-directed and a specific deformation to the coupling means in order to assert that any other, crash-induced unlatching motion of the means can be effectively compensated.

For instance, if the unlatching motion initiated by the latch-releasing actuator is conducted as push motion, the impact-member-induced deformation of the coupling means will lead to an effective contraction of the coupling means and of the unlatching rod. In the opposite case, where the unlatching motion transferred from the latch-releasing actuator to the latch mechanism is conducted as a pull motion, the impact member and the coupling means will be designed such that the coupling means effectively elongate in order to assert, that the latch mechanism remains in its latched configuration.

According to a preferred embodiment, the coupling means comprise a rod being pivotably connected to the latch mechanism and/or to the actuator. In particular, the coupling means may be designed as a rather rigid unlatching rod, which is adapted to transfer compressive as well as tensile forces.

The pivotable coupling between the unlatching rod and the actuator or the latch mechanism can be provided by means of a lever being pivotably supported at the actuator and/or the latch mechanism of respective actuator- and latch modules.

According to a preferred embodiment of the invention, the impact member is mechanically coupled with an outer door panel of the vehicle side door assembly. It is further adapted to be shifted at least in cross-vehicle direction in order to deform or to distort the coupling means. The impact member is therefore adapted to actively distort or to actively deform and to manipulate the mechanical coupling between the latch-releasing actuator and the latch mechanism, in particular in such cases, where an externally applied force exerted into the side door in cross-vehicle direction exceeds a predefined threshold, which may typically arise a vehicle crash situation.

According to another embodiment, the impact member is at least partially disposed between an outer door panel of the vehicle door assembly and a handle module, the latter of which being arranged at the inside of the outer door panel. The handle module is that part of a door handle, which is located at the inside of the outer door panel, whereas the handle bar, which is mechanically coupled to the handle module, is disposed outside the outer door panel.

The arrangement of the impact member between the outer door panel and the handle module comes along with the advantage, that an externally induced force effect leading to a mechanical deformation of the outer door panel, can be directly and immediately be utilized to initiate the desired deformation and distortion of the coupling means.

According to a further aspect, the invention focuses in particular only on a distortion or deformation of the coupling means. According to an embodiment of the invention, it is not intended to disassemble or to disengage the coupling between the latch-releasing actuator and the latch mechanism. In this way it can be asserted, that the side door remains in its latched and locked configuration, thus minimizing the potential for an unintentional opening. However, since the coupling means are only to be mechanically deformed or distorted, their functionality may remain intact even after the crash occurred. Hence, the vehicle door may eventually be opened in an easy way for evacuating passengers of the vehicle.

According to another preferred embodiment of the invention, the impact member comprises a protruding portion, which substantially extends in cross-vehicle direction. A free end of the protruding portion facing inward and away from the outer door panel is adapted to interact with the coupling means in such a way, that the coupling means become deformed or distorted upon impact with the protruding portion of the impact member.

The protruding portion may further comprise a lateral expansion, corresponding to the distance between the coupling means and the outer door panel. Hence, in an initial position, the free end of the protruding portion may almost be in contact with the coupling means. In this way, it can be asserted or ensured, that already a slight deformation of the outer door panel inducing a lateral movement of the protruding portion of the impact member finally leads to the intended deformation or distortion of the coupling means.

Moreover, the impact member may further comprise a mounting portion, which is adapted to be disposed between the outer door panel and a handle module of the vehicle door. The entire impact member is preferably designed as sheet metal and comprises a structure and geometry, which is adapted to the outer contour of the handle module and to the inward facing contour or surface of the adjacent outer door panel.

The mounting portion as well as the protruding portion may comprise a rather flat and a substantially even geometry. The protruding portion and the mounting portion of the impact member may typically form an angle of approximately 90° or less. In typical embodiments, the angle between the protruding portion and the mounting portion is between approximately 75° and approximately 85°, preferably, it is around 80°.

According to another embodiment, the mounting portion of the impact member and the handle module comprise mutually corresponding positive locking means. In particular, the impact member and its mounting portion comprise at least one aperture, which is adapted to receive at least those portions of the handle module, that abut against the inside surface of the outer door panel. Moreover, this aperture further allows an assembly of the handle module at the door panel in such a way, that the impact member and its mounting portion is simply squeezed and sandwiched between the handle module and the inside surface of the outer door panel. In this way, the assembly of the impact member at the door structure can be conducted without any further or additional assembling means, like screws or bolts.

The aperture of the disassembling member may further comprise some inward pointing projections or portions providing a correct and easy assembly and adjustment of the impact member in order to prevent any misalignment with respect to the position of the handle module.

According to another aspect, the impact member is integrally formed with a door beam or with a comparable door structure member or door support structure. Hence, the impact member may be designed as an inward pointing protrusion of a member of the door support structure, whereby this member is adapted to absorb crash-induced deformation in the region of the vehicle side door.

According to another embodiment, the coupling means, the latch-releasing actuator and the latch mechanism are designed in such a way, that the coupling means transfer a compressive force to the latch mechanism in response to an activation of the latch-releasing actuator. In this embodiment, the geometry and the relative position of the coupling means and the impact member are designed in such a way, that due to a deformation of the coupling means, a tensile force is at least temporarily exerted to the latch mechanism. Exertion of this tensile force is typically accompanied by an at least local deformation of the coupling means, leading to an effective contraction of the latch-releasing rod itself.

According to another preferred embodiment, the protruding portion of the impact member comprises a receptacle at its free end, which is pointing towards the coupling means. This receptacle is further adapted and designed for receiving the coupling means during a crash-induced deformation of structural members of the side door assembly, such as the outer door panel.

The receptacle may comprise a concave-shaped contour. Additionally, the shape of the receptacle and its arrangement in relation to the unlatching rod may be designed such, that the rod is disposed within a semi circular or concave section of the protruding portion of the impact member. In this way not only a lateral but also a longitudinal or any inclined crash-induced displacement of the impact member may lead to the intended deformation of the coupling means.

According to another preferred embodiment, the coupling means, being typically designed as unlatching rod comprise at least one indent facing towards the impact member and being arranged opposite to the free end of the protruding portion of the impact member. Since the impact member is adapted to deform the unlatching rod in a direction transverse to the elongation of the rod, by means of this indent, a kind of interlock or mechanical coupling between the impact member and the unlatching rod for the purpose of the rod's deformation can be provided.

According to a further preferred embodiment, the impact member is mechanically coupled with the outer door panel and its protruding portion is further adapted to be shifted at least in cross-vehicle direction in order to deform the coupling means. Additionally or alternatively, the protruding portion of the impact member may also become subject to a pivotal movement, depending on the type of deformation of the outer door panel. However, the intended deformation of the coupling means may arise in either case irrespective on whether the protruding portion of the impact member is laterally shifted or pivoted towards the coupling means.

According to another aspect of the invention, the impact member is attached or mechanically coupled to a shifting element, which is slidably mounted in cross-vehicle direction and which is further coupled to a distance sensing arrangement being adapted to push the shifting element and the impact member in cross-vehicle direction in response to a varying distance between the actuator and the latch mechanism. Hence, the distance sensing arrangement is adapted to monitor the relative distance between the latch mechanism and the actuator.

In cases, in which this distance becomes subject to a modification, which might be crash-induced, the distance sensing arrangement is adapted to slidably push the shifting element in cross-vehicle direction such that the impact member interacts with the coupling means in order to deform the latter.

In a further embodiment, the shifting element comprises a wedge-like shape and it is further adapted to cooperate with a corresponding wedge-shaped pushing element. The pushing element is rigidly coupled to the actuator or to the latch mechanism. If the distance between latch mechanism and actuator changes, in particular if the distance decreases, the pushing element with its slanted surface will interact with a corresponding slanted surface of the wedge-like shaped shifting element in order to induce a motion of the shifting element in cross-vehicle direction, finally leading to the intended deformation of the coupling means.

BRIEF DESCRIPTION OF THE DRAWINGS

The present invention will hereinafter be described in conjunction with the following drawing figures, wherein like numerals denote like elements, and.

DETAILED DESCRIPTION

The following detailed description is merely exemplary in nature and is not intended to limit application and uses. Furthermore, there is no intention to be bound by any theory presented in the preceding background and summary or the following detailed description.

Figure 1:
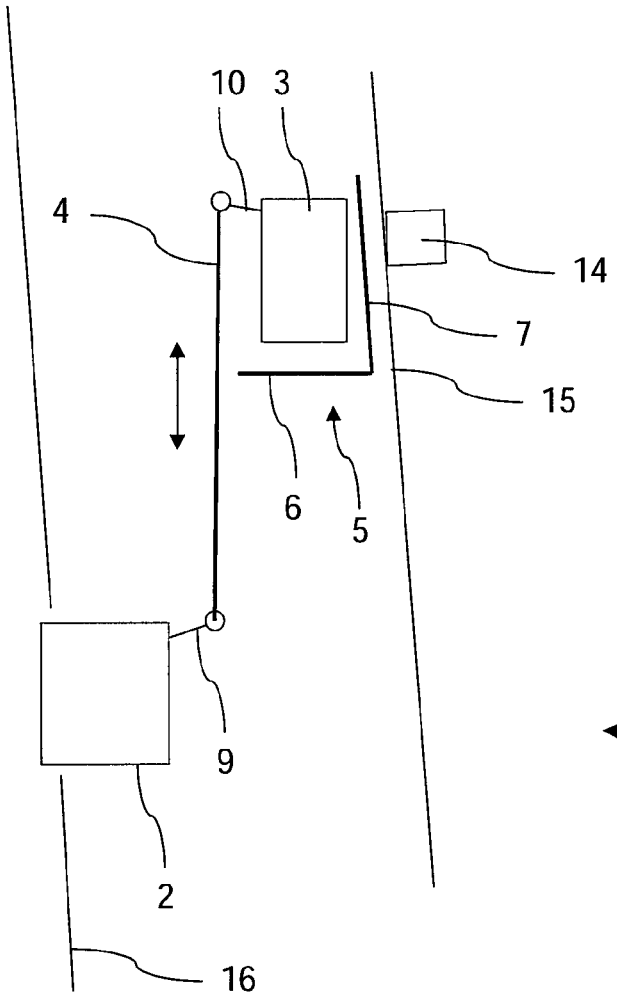
FIG. 1 schematically illustrates a vehicle side door in cross-section.

The schematic illustration of FIG. 1 shows a vehicle door 1, in particular a side door of a car that comprises a latch mechanism 2, a handle module 3 and an unlatching rod 4 coupling and interconnecting the handle module 3 and the latch mechanism 2. Further, a handle bar 14 is indicated, which is mechanically interacting with the handle module 3. The handle bar 14 and the handle module 3 together serve as a latch-releasing actuator. As can further be seen from FIG. 1, the latch mechanism 2 is disposed in vicinity to an inner door panel 16, whereas the actuator is disposed at an outer door panel 15.

The latch mechanism 2 as well as the handle module 3 comprise a lever 9, 10, in particular a bell crank lever. By means of pivoting the lever 9 of the latch mechanism 2, the latch mechanism can be unlatched, whereby a detent element of the latch mechanism gives way to a latch member being disposed at the door frame, being not explicitly illustrated in the Figures.

In order to provide a latch releasing motion, the lever 10 of the handle module 3 is pivoted in downward direction and the unlatching rod 4 transfers a resulting compressive action or force to the lever 9 of latch mechanism 2, thus leading to a conventional unlatching of the door 1.

Figure 4:
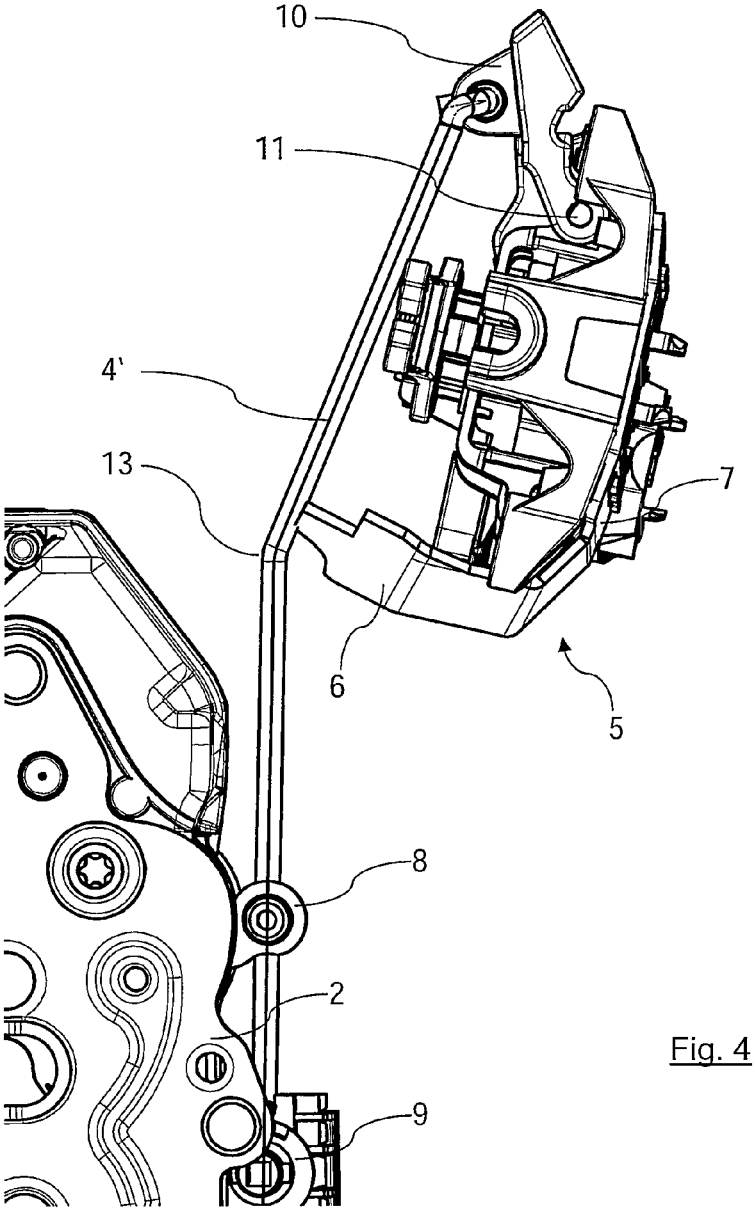
FIG. 4 illustrates the embodiment according to FIG. 3 and FIG. 4, in which the unlatching rod is deformed.

Further, an impact member 5 comprises a protruding portion 6 and a mounting portion 7 is sandwiched between the door panel 15 and the handle module 3 with its mounting portion 7. Due to this assembly, the protruding portion 6 is pointing towards the unlatching rod and may interact with the unlatching rod 4 in a crash situation, which leads to a local deformation of the rod as illustrated in FIG. 4.

Figure 3:
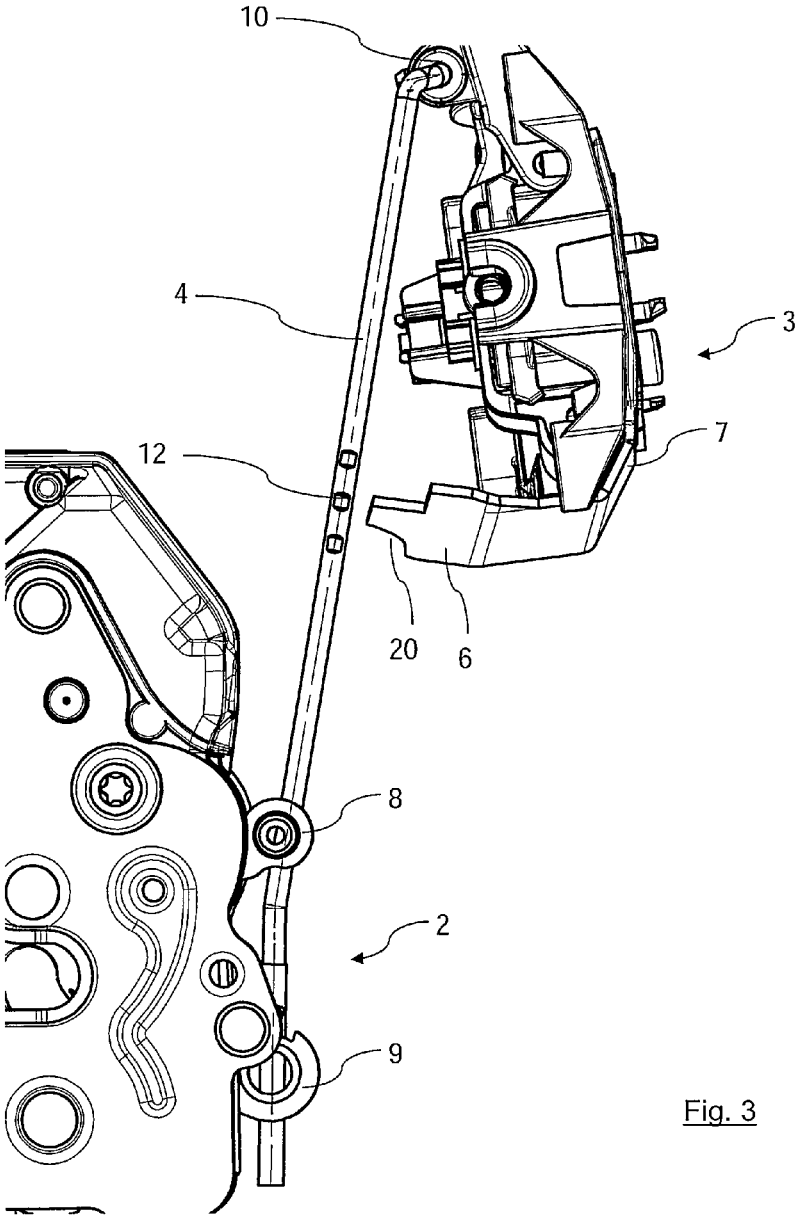
FIG. 3 shows the embodiment according to FIG. 2 in another perspective view.

As further illustrated in FIG. 3, the latch mechanism 2 comprises two separate levers 8, 9. Whereas lever 9 is mechanically coupled to the latch-releasing actuator, the additional lever 8 serves as a locking lever, which may be coupled to the key cylinder of the handle module 3 by means of a separate lock rod. This locking-related lever 8 is adapted to switch the latch mechanism either into an idle state or into an active position. In the active position, a motion or movement of the unlatching rod 4 will lead to an actual unlatching of the latch mechanism 2. However, in the idle state, any movement or motion of the unlatching rod 4 has basically no effect to the latch mechanism 2.

Figure 2:
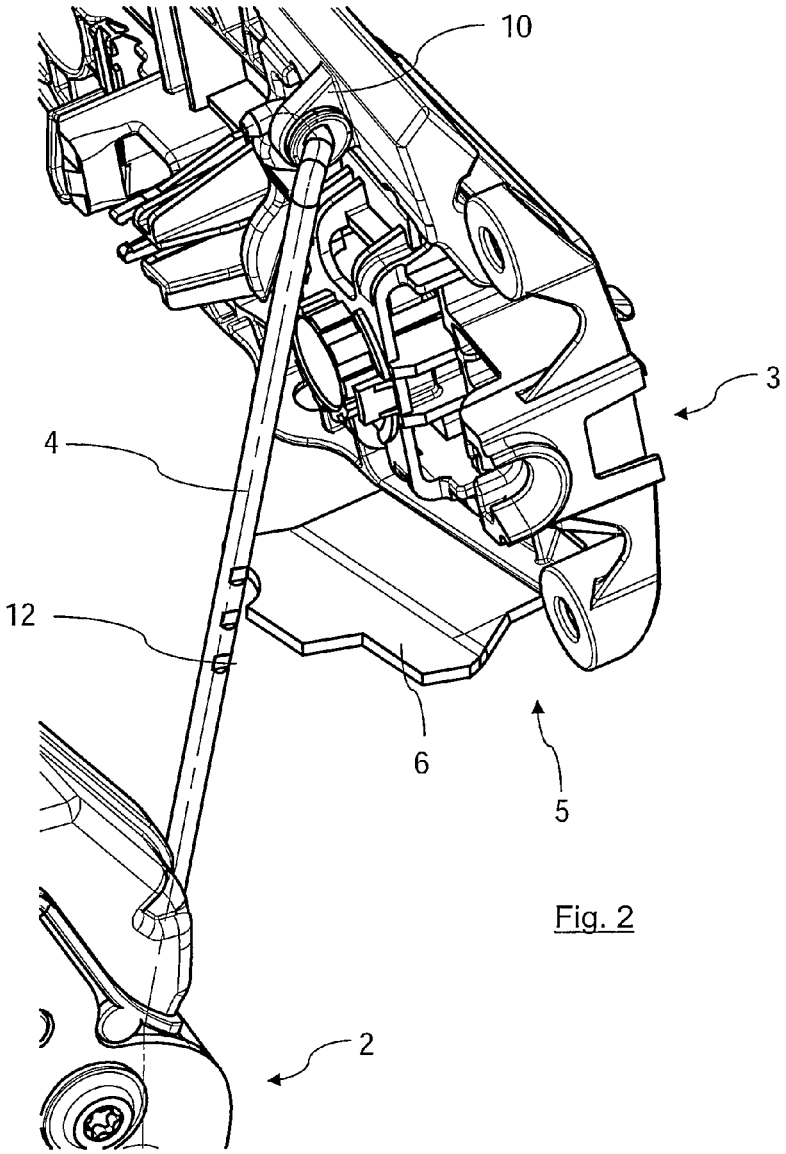
FIG. 2 depicts a detailed perspective view of a handle module and a latch mechanism being interconnected by means of an unlatching rod.

As further shown in FIG. 2 and FIG. 3, the unlatching rod 4 comprises various indents 12 in a region close to or opposite to the free end of the protruding portion 6 of the impact member 5. On the one hand side, these indents 12 provide a kind of mechanical coupling between the protruding portion 6 and the unlatching rod 4. On the other hand side, these indents 12 also provide at least a slight structural weakening of the unlatching rod 4 in order to facilitate the intended deformation as indicated by the illustration of FIG. 4. Here, the deformed rod 4' comprises a bend 13 opposite to the free end of the protruding portion 6 of the impact member 5.

The lever 10 of the handle module 3 is pivoted with respect to a pivot axis 11. Hence, due to a user-initiated actuation of the handle bar 14, this lever 10 rotates with respect to the pivot axes 11 in a counter-clockwise direction, thus transferring a downward directed motion and a respective pivoting to the lever 9 of the latch mechanism 2. The crash induced deformation of the unlatching rod 4' as illustrated in FIG. 4 provides an effective contraction of the unlatching rod 4'. Hence, the effective distance between the coupled levers 9, 10 is contracted or shortened and nearly any crash-induced deformation which may otherwise lead to an unlatching pivoting of the lever 9 can be effectively counteracted and prevented.

FIG. 5 through FIG. 8 shows the impact member 5 in various perspective views. As can be seen from FIG. 7, the protruding portion 6 and the mounting portion 7 form an angle of about 80°. The overall geometry of the impact member 5 is thereby governed by the geometry of the outer door panel 15 and the geometry of the handle module 3. The mounting portion 7 of the impact member 5 comprises an aperture 19, which receives those portions of the handle module 3 that are adapted to get in direct contact with the inner surface of the outer door panel 15 in a final assembly position, which is not explicitly shown in the figures.

In this way, conventional fastening means of the handle module 3 but also mechanical and electrical activating means, that have to be coupled to the handle bar 14, have not to be redesigned because of the impact member 5 being additionally disposed in the side door assembly.

Figure 5:
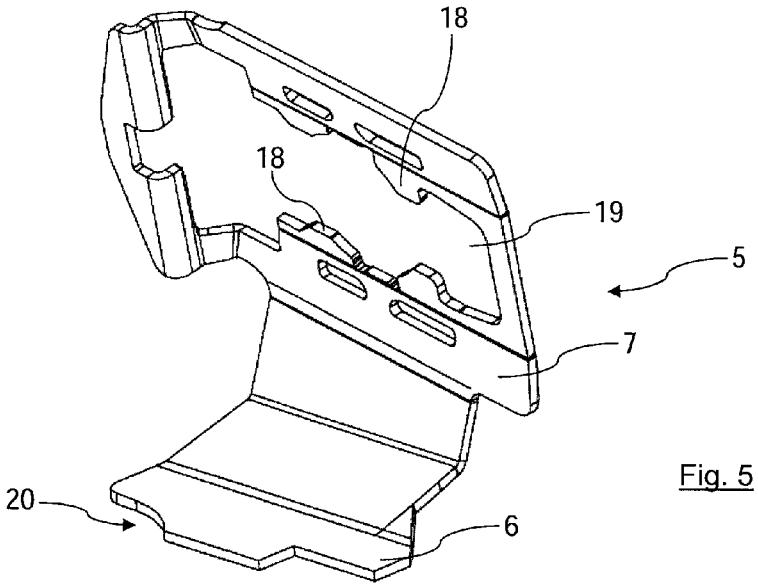
FIG. 5 in a perspective view illustrates the impact member.
Figure 6:
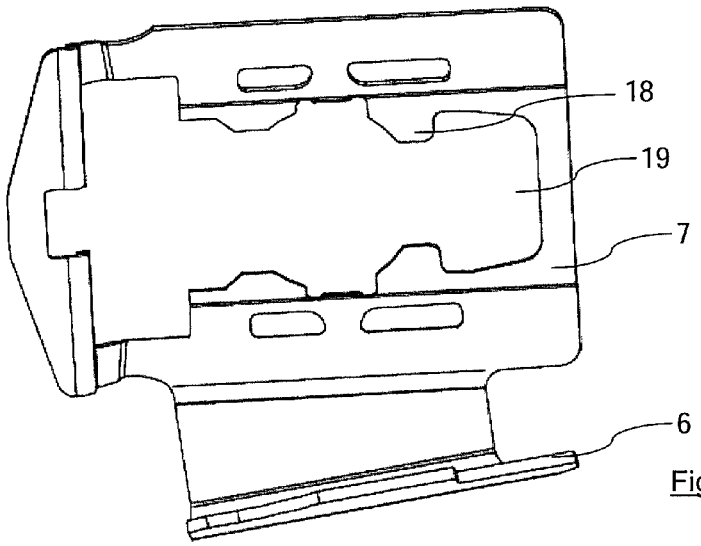
FIG. 6 shows the impact member as seen in cross-vehicle direction.
Figure 7:
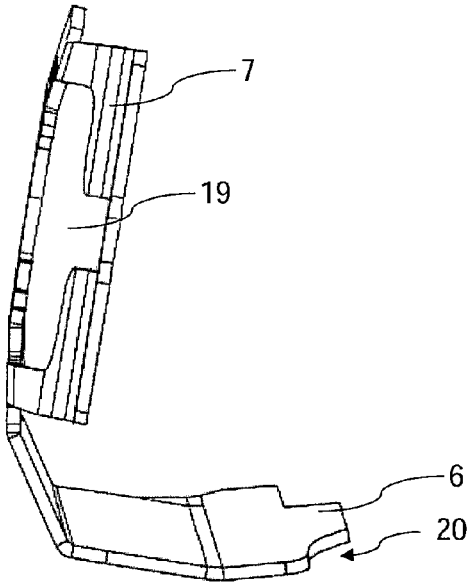
FIG. 7 shows the impact member as seen in direction of the vehicle long-axis.

Further, with respect to FIG. 5 and FIG. 6, the aperture 19 has inward pointing or inwardly protruding portions 18, which may positively engage with corresponding depressions or cavities of the handle module 3 or the door panel 15. In this way, a firm and tight fixing of the impact member 5 sandwiched between outer door panel 15 and handle module 3 can be achieved, even without additional fastening elements.

Furthermore, the shape and geometry of the impact member 5 is designed such that it fits and corresponds to the contour and geometry of already existing and commercially available handle modules 3 and door panels 15. It can be therefore easily embedded in an existing production run.

Figure 8:
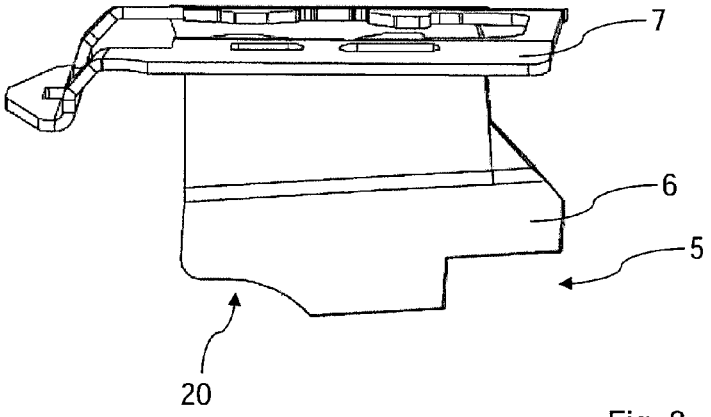
FIG. 8 illustrates the impact member from above.

Additionally, as can be seen from FIG. 3, FIG. 4 and FIG. 8, the protruding portion 6 of the impact member 5 has a receptacle 20 comprising a conical or substantially quarter-circular shape. This receptacle 20 may impinge the unlatching rod 4. In this way, an even more reliable deformation of the unlatching rod 4 can be provided.

Apart from the illustrated quarter-circular shaped receptacle, also other types of curved and concave or corrugated receptacles are conceivable and are in the scope of the present invention. In particular, the receptacle may at least partially surround the unlatching rod even in an initial configuration.

Figure 9:
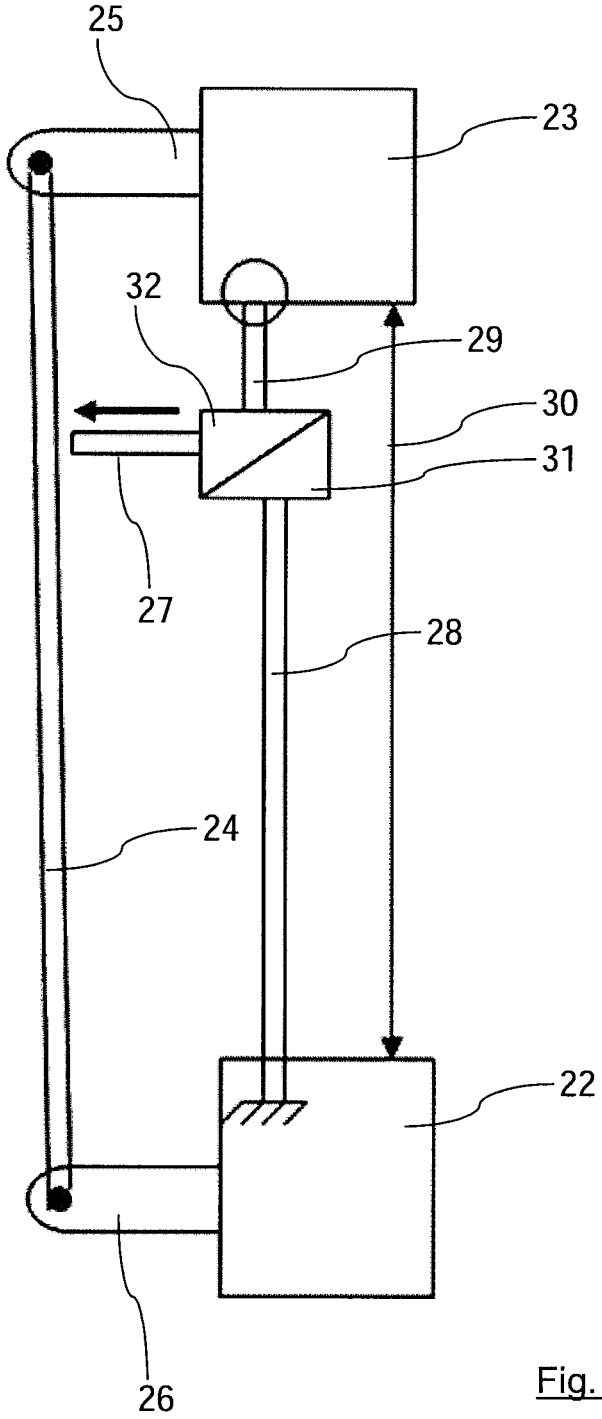
FIG. 9 schematically illustrates another embodiment for providing a deformation of the unlatching rod.

FIG. 9 schematically illustrates another embodiment being adapted to provide a deformation of an unlatching rod 24 in response to a variation in distance 30 between a handle module 23 and a latch mechanism 22. Also here, the latch mechanism 22 and the handle module 23 each comprise a pivotable lever 26, 25. Both levers 25, 26 at their free end are pivotably interconnected by means of a rigid unlatching rod 24.

Further, two additional rods 28, 29, each of which being coupled to a wedge-shaped element 31, 32 provide a distance sensing arrangement between the handle module 23 and the latch mechanism 22. In the illustrated embodiment, the lower rod 28 is rigidly coupled and connected to the latch mechanism 22. In contrast to that, the upper rod 29 only abuts the lower surface of the handle module 23. However, it is slidably mounted in cross-vehicle direction with respect to the handle module 23 (i.e., in horizontal direction according to the illustration of FIG. 9). In particular, the wedge 32 is rigidly connected to the horizontally elongated impact member 27 and to the vertically elongated rod 29.

In case of a vehicle crash, the distance 30 between the handle module 23 and the latch mechanism 22 may decrease. This variation in distance is transferred to the arrangement of rods 28, 29, wedges 31, 32. In detail, an upward pointing motion of the lower rod 28 and the connected wedge 31 leads to a horizontal shifting of the wedge 32 and its impact member 27, finally leading to an intended deformation of the unlatching rod 24.

While at least one exemplary embodiment has been presented in the foregoing summary and detailed description, it should be appreciated that a vast number of variations exist. It should also be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

What is claimed is:

1. A vehicle door of a motorized vehicle, comprising:

a latch mechanism configured to cooperate with a latch member disposed at a door frame;

an actuator configured to unlatch the latch mechanism, the actuator being disposed at a distance from the latch mechanism;

a coupling configured to mechanically couple the actuator and the latch mechanism and to transfer an unlatching motion from the actuator to the latch mechanism; and an impact member configured to deform the coupling in such a way that a deformation of the coupling is adapted to counteract the unlatching motion.

2. The vehicle door according to claim 1, wherein the coupling comprises a rod pivotably connected to the latch mechanism.

3. The vehicle door according to claim 1, wherein the coupling comprises a rod pivotably connected to the actuator.

4. The vehicle door according to claim 1, wherein the impact member is configured to impact and impinge the coupling in response to an externally induced deformation of a door structure.

5. The vehicle door according to claim 1, wherein the impact member is disposed between an outer door panel and a handle module disposed at an inside of the outer door panel.

6. The vehicle door according to claim 5, wherein the impact member comprises a protruding portion and a mounting portion, wherein the protruding portion substantially extends in a cross-car direction and wherein the mounting portion extends substantially parallel to the outer door panel in a vicinity of the handle module.

7. The vehicle door according to claim 6, wherein the mounting portion of the impact member and the handle module comprise mutually corresponding positive locks.

8. The vehicle door according to claim 1, wherein the impact member is integrally formed with a door structure.

9. The vehicle door according to claim 8, wherein the door structure is a door beam.

10. The vehicle door according to claim 1, wherein the coupling in the unlatching motion is designed to transfer a compressive force to the latch mechanism and wherein a geometry and a relative position of the coupling and the impact member is designed such that by the deformation of the coupling a tensile force is at least temporally exerted to the latch mechanism.

11. The vehicle door according to claim 1, wherein a protruding portion of the impact member comprises a receptacle at a free end pointing towards the coupling the receptacle being configured for receiving and securing the coupling during a crash-induced deformation of a door panel.

12. The vehicle door according to claim 8, wherein the coupling comprise at least one indent opposite to a free end of a protruding portion of the impact member.

13. The vehicle door according to claim 5, wherein the impact member is mechanically coupled with the outer door panel and wherein a protruding portion is configured to be shifted at least in a cross-vehicle direction in order to deform the coupling.

14. The vehicle door according to claim 1, wherein a geometry and a relative position of the coupling and the impact member are designed such that an effective length of the coupling is reduced in a crash situation.

15. The vehicle door according to claim 1, wherein the impact member is attached to a shifting element that is slidably mounted in a cross-vehicle direction and further coupled to a distance sensing arrangement adapted to push the shifting element and the impact member in the cross-vehicle direction in response to a varying distance between the actuator and the latch mechanism.

16. The vehicle door according to claim 15, wherein the shifting element comprises a wedge-like shape and is further adapted to co-operate with a corresponding wedge-shaped pushing element rigidly coupled to the actuator.

17. The vehicle door according to claim 15, wherein the shifting element comprises a wedge-like shape and is further adapted to co-operate with a corresponding wedge-shaped pushing element rigidly coupled to the latch mechanism.

* * * * *